US010617277B2

(12) United States Patent
Lehmann et al.

(10) Patent No.: US 10,617,277 B2
(45) Date of Patent: Apr. 14, 2020

(54) CLEANING DEVICE AND METHOD FOR CLEANING ITEMS TO BE CLEANED

(71) Applicant: MEIKO Maschinenbau GmbH & Co. KG, Offenburg (DE)

(72) Inventors: Denis Lehmann, Ortenberg (DE); Thomas Loos, Hohberg (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 137 days.

(21) Appl. No.: 15/797,785

(22) Filed: Oct. 30, 2017

(65) Prior Publication Data

US 2018/0055329 A1 Mar. 1, 2018

Related U.S. Application Data

(63) Continuation of application No. PCT/EP2017/057540, filed on Mar. 30, 2017.

(30) Foreign Application Priority Data

Mar. 31, 2016 (DE) ..... 10 2016 205 367

(51) Int. Cl.
*A47L 15/00* (2006.01)
*A47L 15/24* (2006.01)
(Continued)

(52) U.S. Cl.
CPC ..... *A47L 15/0081* (2013.01); *A47L 15/4259* (2013.01); *A47L 15/4261* (2013.01);
(Continued)

(58) Field of Classification Search
CPC ..... A47L 15/0081; A47L 15/241; A47L 15/4259; A47L 15/4261; A47L 15/46;
(Continued)

(56) References Cited

FOREIGN PATENT DOCUMENTS

DE 10054392 A1 5/2002
DE 202007006818 U1 10/2007
(Continued)

OTHER PUBLICATIONS

Takeda et al., "JP2013027630A English Machine Translation.pdf", Feb. 7, 2013—Machine translation from Espacenet.com.*
English Translation of International Preliminary Report on Patentability, PCT/EP2017/057540, Oct. 11, 2018, 10 pages.
English Translation of International Search Report, PCT/EP2017/057540, May 23, 2017, 3 pages.

*Primary Examiner* — Levon J Shahinian
(74) *Attorney, Agent, or Firm* — Bose McKinney & Evans LLP

(57) ABSTRACT

Disclosed is a cleaning device for cleaning items to be cleaned. The cleaning device has at least one cleaning chamber and at least one covering device at least partially surrounding the cleaning chamber. The covering device can be moved in an opening movement direction from a closed position into an open position or in a closing movement direction from an open position into a closed position by means of at least one electromechanical drive via at least one transmission. The cleaning device furthermore has a sensor, which is designed to detect an action of a manual force on the covering device in the opening movement direction or in the closing movement direction. The cleaning device is furthermore designed to control the electromechanical drive in accordance with the detection of the action of the manual force.

12 Claims, 3 Drawing Sheets

(51) Int. Cl.
*A47L 15/42* (2006.01)
*A47L 15/46* (2006.01)

(52) U.S. Cl.
CPC ..... *A47L 15/241* (2013.01); *A47L 15/46* (2013.01); *A47L 2401/26* (2013.01); *A47L 2401/30* (2013.01); *A47L 2401/32* (2013.01); *A47L 2401/34* (2013.01); *A47L 2501/22* (2013.01); *A47L 2501/26* (2013.01); *A47L 2501/28* (2013.01)

(58) Field of Classification Search
CPC ..... A47L 2401/26; A47L 2401/30; A47L 2401/32; A47L 2401/34; A47L 2501/22; A47L 2501/26; A47L 2501/28
USPC ..... 134/56 D, 57 D, 58 D
See application file for complete search history.

(56) References Cited

FOREIGN PATENT DOCUMENTS

| | | | |
|---|---|---|---|
| DE | 102007003451 | A1 | 8/2008 |
| DE | 102008028313 | A1 | 12/2009 |
| DE | 102012223219 | A1 | 6/2014 |
| DE | 102012223775 | A1 | 6/2014 |
| EP | 2428153 | A1 | 3/2012 |
| EP | 2497405 | A2 | 9/2012 |
| JP | 2005124800 | A | 5/2005 |
| JP | 2013027630 | A | 2/2013 |
| JP | 2013200301 | A1 | 10/2013 |
| WO | WO 2009132813 | A1 | 11/2009 |
| WO | WO 2015172877 | A1 | 11/2015 |
| WO | WO 2016156146 | A1 | 10/2016 |

* cited by examiner

CLEANING DEVICE AND METHOD FOR CLEANING ITEMS TO BE CLEANED

RELATED APPLICATIONS

This application is a continuation of PCT/EP2017/057540, filed Mar. 30, 2017, which claims priority to DE 10 2016 205 367.1, filed Mar. 31, 2016, the entire disclosures of which are incorporated herein by reference in their entireties.

BACKGROUND

This disclosure relates to a cleaning device and to a method for cleaning items to be cleaned. Such cleaning devices and methods can be used, in particular, in the domain of dishwashing technology, particularly in the commercial sector of canteens and facilities for mass catering. For example, this disclosure can be used for cleaning items to be cleaned in the form of objects for preparing, serving, storing or holding meals or drinks, e.g., crockery, cutlery, glasses, cups, pots, dishes or trays. In particular, this disclosure can be used in hood-type dishwashers or pass-through dishwashers.

Numerous cleaning devices and methods for cleaning different types of items to be cleaned are known from the prior art. Without restricting further possible uses, this disclosure is described below with respect to dishwashing technology, i.e., with respect to cleaning devices in the form of dishwashers. In particular, these can be commercial dishwashers, wherein a description is given below, in particular, of pass-through dishwashers or hood-type dishwashers, once again without restricting other possible embodiments. Examples of such dishwashers are, in particular, the DV Series or EcoStar Series dishwashers produced by Meiko Maschinenbau GmbH & Co. KG, Offenburg, Germany, or the PT Series dishwashers produced by Winterhalter Deutschland GmbH, Meckenbeuren, Germany, these all being for glasses and crockery. However, it is also possible, in principle, for this disclosure to be used in other products.

In the case of known hood-type dishwashers, the hood is usually guided by means of a suitable guide, wherein the operating personnel can move the hood from a closed position into an open position or vice versa by means of appropriate handles and/or levers. In addition, however, the prior art also includes automatic hood-type dishwashers in which a hood movement is performed automatically, being driven, for example, by a motor. Here, the hood movement is generally initiated by transmitting an appropriate signal via a control panel of the hood-type dishwashers. As an alternative or in addition, it is also possible for separate buttons or switches to be provided. However, the disadvantage with arrangements of this kind is that, although the control elements can in principle be positioned as desired, they each have to be wired separately, which is complicated and expensive in practice. Depending on the local conditions and the respective situation where the dishwasher is set up, the actuating elements are not always easy for the operator to reach. Where the hood movement is triggered solely via the control panel of the dishwasher, initiation of the hood movement requires the operator to leave their work position, which is usually situated to the side of the dishwasher, e.g., at a sink with a pre-rinsing spray.

The prior art also discloses automatic triggering processes. For this purpose, various sensors are used in domestic appliances and items of equipment, said sensors receiving certain signals and initiating an opening process of a door or of a drawer accordingly. WO 2009/132813 A1, for example, discloses a dishwasher having a decor panel designed as a contact sensor. DE 10 2008 028 313 A1 discloses a capacitive contact switch for a domestic appliance. EP 2 428 153 B1 describes a domestic appliance having a door opening sensor for detecting an acoustically expressed desire to open the door. EP 2 497 405 A2 describes a domestic appliance having a knock sensor, by means of which a knock signal input is made possible. DE 10 2007 003 451 A1 and DE 20 2007 006 818 U1 describe a cupboard which has one or more drawers and a polydirectional microphone as well as solid body sound sensors. DE 10 2012 223 775 A1 describes a domestic appliance having a structure-borne noise sensor, which is designed to detect the sound of the tread of a person moving in the area surrounding the domestic appliance. DE 10 2014 007 172 A1 describes an electronic domestic appliance having a gesture detection device.

Despite the advantages associated with these improved sensors, there remain numerous technical challenges. Thus, one challenge is that, for example, in many cases, signals are not unambiguous or cannot be interpreted unambiguously. In the often turbulent circumstances of a canteen kitchen, acoustic signals, haptic signals or even structure-borne noise, in particular, can arise even when these are not intended to trigger a particular response from the dishwasher. However, an incorrectly triggered response can interrupt the workflow and thus lead to unwanted disruptions. Moreover, many of the sensors mentioned are expensive and furthermore sensitive to environmental influences, this often representing a technical challenge, especially with respect to the working conditions in canteen kitchens.

SUMMARY

This disclosure teaches a cleaning device and a method for cleaning items to be cleaned which at least to a large extent avoid the disadvantages of known devices and methods of this kind. In particular, a cleaning device and a method which allow opening or closing of a cleaning chamber of the cleaning device in a simple, inexpensive and user-friendly way are disclosed.

In the text which follows, the terms "have," "exhibit," "comprise" or "include" or any desired grammatical derivatives thereof are used in a nonexclusive sense. Accordingly, these terms can relate both to situations in which there are no further features in addition to the features introduced by these terms or to situations in which one or more further features are present. For example, the expression "A has B," "A exhibits B," "A comprises B" or "A includes B" can relate both to the situation in which there is no further element in A apart from B (i.e., to a situation in which A consists exclusively of B) and to the situation in which, in addition to B, there are one or more further elements in A, e.g., element C, elements C and D or even further elements.

Attention is furthermore drawn to the fact that the terms "at least one" and "one or more" and grammatical derivations of these terms, when these are used in combination with one or more elements or features and are intended to express the fact that the element or feature can be provided in a single instance or in multiple instances, are generally used only once, e.g., when the feature or element is first introduced. When the feature or element is subsequently mentioned, the corresponding term "at least one" or "one or more" is generally no longer used, but there is no restriction on the possibility of providing the feature or element in a single instance or in multiple instances. Thus, it shall be understood that various structural terms used throughout this disclosure and claims should not receive a singular interpretation unless it is made explicit herein. By way of non-limiting example, the terms "chamber," "cover," "electromechanical drive," to name a few, should be interpreted when appearing in this disclosure and claims to mean "one or more" or "at least one," even when not explicitly stated. All other terms used herein should be similarly interpreted unless it is made explicit that a singular interpretation is intended. As noted above, while this disclosure uses the phrase "at least one" in several instances throughout, when a structural or functional feature is listed in the specification or claims without being preceded by the phrase "at least one," said feature shall still be interpreted as meaning "at least one" or "one or more."

Moreover, in the text which follows, the terms "preferably," or "in particular," "for example" or similar terms are used in association with optional features without thereby restricting alternative embodiments. Thus, features which are introduced by these terms are optional features, and there is no intention to restrict the scope of protection of the claims and, in particular, the independent claims by means of these features. Thus, as a person skilled in the art will recognize, the invention can also be implemented using different embodiments. In a similar way, features which are introduced by "in one embodiment of the invention" or by "in one illustrative embodiment of the invention" are understood to be optional features without any intention thereby to restrict alternative embodiments or the scope of protection of the independent claims. Moreover, these introductory expressions are not intended to affect all the ways of combining the features introduced thereby with other features, whether optional or non-optional features.

In a first aspect of this disclosure, a cleaning device for cleaning items to be cleaned is proposed. In general terms, a cleaning device within the context of this disclosure should be taken to mean a device in which the items to be cleaned are cleaned by means of at least one cleaning fluid in order to free them at least partially from adhering dirt and/or other contaminants. In particular, the cleaning fluid can comprise at least one cleaning liquid. In addition, the cleaning device can also exert a germicidal action or even a disinfectant action on the items to be cleaned. Accordingly, a method for cleaning items to be cleaned, as proposed in a second aspect of this disclosure, also referred to below as a cleaning method, is taken to mean applying at least one cleaning fluid to the items to be cleaned for the purpose of at least partially removing adhering dirt from the items to be cleaned.

Here, items to be cleaned can be taken to mean, in general, items which can be subjected to cleaning or a cleaning method, e.g., industrial articles. Without restricting other possible embodiments, reference is made below to items to be cleaned in the form of items to be washed and/or crockery. Here, items to be washed is, in principle, intended to include any objects which are used to prepare, store, serve or transport meals and/or drinks. In particular, they can be items to be washed selected from the group comprising crockery such as cups, plates, glasses, dishes or bowls; pots; trays; cutlery; warming devices; containers; crates; baskets. Other devices which can be used directly or indirectly for processing, preparing, transporting or serving meals and/or drinks or preliminary stages of meals and/or drinks can be used. Thus, in particular, the cleaning device can be embodied as a dishwasher and, particularly preferably, as a hood-type dishwasher and/or pass-through dishwasher.

The cleaning device furthermore comprises at least one cleaning chamber and at least one covering device at least partially surrounding the cleaning chamber. In general, a cleaning chamber can be taken to mean a space which is completely or at least partially screened off and in which the items to be cleaned are supplied with at least one cleaning fluid and/or with a plurality of cleaning fluids. Thus, it is possible, for example, to provide within the cleaning chamber at least one application device for applying the at least one cleaning fluid to the items to be cleaned. It is furthermore also possible for the items to be cleaned to be completely or partially dried within the cleaning chamber. In particular, the cleaning device can be embodied as a single-chamber cleaning device. The items to be cleaned may also be referred to below as items to be washed, and the cleaning chamber may also be referred to as a washing chamber.

As explained above, the cleaning device has at least one covering device at least partially surrounding the cleaning chamber. Here, a covering device (also referred to as a "cover") should be taken to mean, in general, a device or an element which at least partially delimits the cleaning chamber and, at the same time, allows access to the cleaning chamber, e.g., to load the cleaning chamber with items to be cleaned or for removing the items to be cleaned from the cleaning chamber. Thus, the covering device can, in particular, form a chamber wall of the cleaning chamber or a part of a chamber wall of the cleaning chamber. In particular, as explained below in greater detail, the covering device can be embodied completely or partially as a hood and/or a jacket, which is/are mounted so as to be movable in a vertical direction. For example, the covering device can comprise a hood which can be moved upward in order to open the cleaning chamber and which can be moved downward in order to close off the cleaning chamber, e.g., together with a base of the cleaning device.

The covering device can be moved in an opening movement direction from a closed position into an open position or in a closing movement direction from an open position into a closed position by means of at least one electromechanical drive via at least one transmission. Thus, the covering device is in general mounted so as to be movable, thus allowing it to be moved into at least two different positions, namely an open position and a closed position. Intermediate positions are also possible. The plurality of possible positions between the open position and the closed position, optionally including the open position and the closed position, can also be referred to as the opening path.

In the context of this disclosure, a "transmission" can generally be understood to mean a machine element by means of which force and/or torque can be transmitted between a drive and a driven element. In particular, it is also possible for amounts of movement to be modified by means of a transmission. For example, a force or a torque can be modified by means of the transmission. In particular, a movement to be modified can be a rotary movement. In particular, the transmission can thus also comprise a torque converter.

In particular, the transmission can comprise at least one traction-means transmission, in particular at least one chain drive. Here, a traction-means transmission should be taken to mean, in general, a transmission in which a torque is transmitted between two elements, e.g., between at least one shaft and at least one further element, in particular also between two shafts, with the aid of a traction means, e.g., a traction means wrapped around the at least one shaft. In general, a traction means (also referred to as "traction element" or "traction member") can be taken to mean a deformable, e.g., flexible or stretchable elongate element, by means of which a traction force can be transmitted. For example, the power transmission section can have at least one traction means, in particular a flexible traction means. In particular, the traction means can be selected from the group comprising: a chain, in particular a roller chain, a plate link chain or a link chain; a cable and/or control cable; a flexible band; a belt, in particular a toothed belt or a V-belt. However, other traction means can also be used in principle.

In the context of this disclosure, an "electromechanical drive" should be taken to mean, in general, a device which is designed to convert electric energy into at least one mechanical movement, in particular a linear movement and/or a rotary movement. In particular, the electromechanical drive can have at least one motor, as will be explained in greater detail below. For example, the electromechanical drive can be coupled to the covering device via the transmission in order to move the covering device in the opening movement direction, that is to say open it completely or partially, and to move it in the closing movement direction, that is to say to close it completely or partially. As an alternative or in addition to the use of a motor, however, it is also possible to use other types of electromechanical drive, e.g., at least one drive selected from the group comprising a hydraulic drive, an electrohydraulic drive, a pneumatic drive or an electropneumatic drive. However, other embodiments are also conceivable.

The cleaning device furthermore has a sensor. The sensor is designed to detect the action of a manual force on the covering device in the opening movement direction or in the closing movement direction. The cleaning device is designed to control the electromechanical drive in accordance with the detection of the action of a manual force.

In the sense according to this disclosure, a "sensor" should be understood to mean fundamentally any element which is designed to detect at least one measured variable and to generate at least one corresponding signal, e.g., an electric signal, e.g., an analog and/or a digital signal. In particular, the at least one sensor can comprise at least one sensor selected from the group comprising a motion sensor, a pressure sensor, a tension sensor, an elongation sensor, an incremental encoder, a final control element, an optical sensor, a mechanical sense, a pneumatic sensor, a hydraulic sensor, an electromagnetic sensor, a magnetic sensor and an electric sensor. Other sensors or combinations of said sensors are possible in principle. In particular, the at least one sensor can comprise at least one angular position sensor, which monitors at least one angular position of at least one shaft connected to the electromechanical drive, in particular the motor.

In the sense according to this disclosure, the "action of a manual force" should be taken to mean fundamentally any action or exertion of a force by a human person, in particular a user. This can be a pushing force, for example, or even a pulling force. The action of the manual force on the covering device, i.e., a force acting on the covering device, can be detected directly or, alternatively, indirectly, for example. Here, direct detection comprises a pulling and/or pushing force acting on the covering device, for example. Here, indirect detection comprises, for example, an effect brought about by the force exerted, e.g., a movement, for example a movement of the covering device and/or of at least one element connected to the covering device, e.g., of the transmission or of a part thereof and/or of the electromechanical drive or of a part thereof, e.g., of a motor or of a shaft connected to the motor. The action of a manual force can take effect completely or partially directly on the covering device and/or completely or partially indirectly, e.g., via at least one element connected to the covering device, e.g., a handle.

The action of a manual force which is detected takes place in the opening movement direction or in the closing movement direction. This means that the force which is exerted manually by the user has at least one force component in the opening movement direction and is preferably oriented parallel to the opening movement direction, or has at least one force component in the closing movement direction and is preferably aligned parallel to the closing movement direction. Thus, in the case of a hood, for example, a force can be exerted upward or downward in a vertical direction, with the result, for example, that the hood rises or falls slightly owing to the action of a manual force, and this can be detected by the sensor.

As explained above, the cleaning device is designed to control the electromechanical drive in accordance with the detection of the action of a manual force. In the context of this disclosure, "control" should fundamentally be taken to mean a way of operating the electromechanical drive, in particular starting the electromechanical drive, stopping the electromechanical drive, changing a driving speed of the electromechanical drive, e.g., a rotational speed of a motor, or changing the direction of the electromechanical drive, e.g., changing a direction of rotation of a motor. For example, control can be exercised by a controller of the cleaning device, said controller acting directly or indirectly on the electromechanical drive in order to exercise control, e.g., in accordance with one or more of said ways.

In the context of this disclosure, control "in accordance with the detection of the action of a manual force" should fundamentally be taken to mean that control can be modified when the action of a manual force is detected. For example, control can be modified if it is detected that the action of a manual force is taking place, and/or the manner of control can be modified if it is detected that the action of a manual force is taking place. As an alternative or in addition, control can also be modified in accordance with the direction of the action of a manual force.

As explained in greater detail below, it is possible, for example, for a movement of the covering device brought about by the action of a manual force to be detected and optionally for the direction thereof to be determined. Accordingly, the electromechanical drive can then be controlled in such a way that it assists the movement of the covering device or continues it alone without the further action of manual force until this movement has reached its end, e.g., the open position or closed position. Thus, in the case of a hood-type dishwasher, for example, it is possible, by means of the at least one sensor, to detect when a user begins to manually open a hood when said hood is in a closed position, e.g., moves the hood slightly upward or exerts an upward force on the hood. The electromechanical drive, e.g., the motor, can be controlled in such a way that this opening movement is assisted by the electromechanical drive or is even continued exclusively by the electromechanical drive, for example until the open position has been reached. On the other hand, if it is detected by means of the at least one sensor that a user begins to manually close a hood when said hood is in an open position, with the user moving the hood slightly downward or exerting a downward force on the hood, for example, the electromechanical drive, e.g., the motor, can be controlled in such a way that this closing movement is assisted by the electromechanical drive or is even continued exclusively by the electromechanical drive, for example until the hood has reached the closed position. Corresponding embodiment and movement is possible in the case of other types of covering device. Here, an opening movement should be taken to mean, in general, a movement in the opening direction, and a closing movement should be taken to mean, in general, a movement in the closing direction.

The cleaning device can be a dishwasher, in particular, or can also comprise a dishwasher. In particular, the dishwasher can be selected from the group comprising a hood-type dishwasher and a pass-through dishwasher. However, other embodiments are also possible in principle. Here, a hood-type dishwasher should be taken to mean, in general, a dishwasher which has a base, which provides a lower side of the washing chamber, and at least one hood or a hood jacket as a covering device, which completely or partially form at least one side wall of the cleaning chamber and, optionally, at least one cover of the cleaning chamber and which can be opened upward or downward in order to expose the cleaning chamber. A pass-through dishwasher should be taken to mean, in general, a dishwasher which has at least one pass-through device, by means of which, e.g., from a feed side, items to be cleaned, e.g., a basket containing items to be cleaned, can be pushed into the washing chamber, e.g., while the hood is open, and in which the items to be cleaned can be pushed out of the cleaning chamber again on a second side, e.g., a removal side, once the cleaning process has been completed. In everyday language, the term "pass-through dishwasher" is often also used as a generic term and also includes hood-type dishwashers with a pass-through device and dishwashers in which only lateral walls can be moved to open the washing space, for example. In general, pass-through dishwashers do not comprise an active pass-through device but comprise manual crockery pass-through. The pass-through device comprises slide rails and/or guides, for example. For examples of such hood-type dishwashers, reference can be made to the prior art mentioned above.

As explained above, the cleaning device can furthermore have, in particular, at least one application device for applying at least one cleaning fluid to the items to be cleaned in the cleaning chamber. For example, one or more cleaning nozzles, via which the cleaning fluid can be sprinkled and/or sprayed and/or dripped onto the items to be cleaned, can be provided in the cleaning chamber. In particular, it is also possible for one or more spray arms to be provided, in particular rotating spray arms.

The cleaning device can furthermore have at least one preparation tank formed separately from the cleaning chamber, in particular at least one boiler. In the preparation tank, the temperature of a rinsing liquid can be set while a washing operation is taking place in the cleaning chamber. Thus, it is possible, in particular, for the cleaning device to be embodied as a commercial dishwasher.

As explained above, the covering device can be embodied in various ways. In particular, the covering device can be selected from the group comprising: a hood at least partially covering and/or surrounding the cleaning chamber; a jacket at least partially surrounding the cleaning chamber; one or more sliding doors. Other embodiments of the covering device are also possible in principle. In particular, the covering device can also be embodied completely or partially as a door, as a slide, as a flap, as a rolling door or as rolling shutters. In the text which follows, the preferred embodiment is described, in which the covering device is embodied completely or partially as a hood and/or as a jacket. The hood and/or the jacket can be opened upward or downward, for example.

The opening movement direction and the closing movement direction can, in particular, each have at least one vertical direction component. The covering device preferably has different potential energy, in particular different position energy, in the closed position and in the open position. Thus, in the open position, the covering device can, in particular, be arranged at least partially above the closed position.

In particular, the covering device can be or comprise a linear-motion covering device. The covering device can perform an exclusively linear movement without a rotary component, particularly between the open position and the closed position or vice versa. This is the case especially with hood-type dishwashers of conventional construction. However, other embodiments with one or more rotary components or with an exclusively rotary movement are also possible in principle. In particular, the cleaning device can have at least one linear guide for the covering device, in particular a guide rail and/or a guide rod.

In particular, the cleaning device can have at least one controller. In the context of this disclosure, a "controller" should fundamentally mean a device which is designed to influence at least one function of the cleaning device. For example, the controller can comprise at least one electric controller, in particular an electric controller having at least one data processing device. For example, the controller can comprise at least one processor, at least one microcomputer or at least one user-specific integrated circuit. Other embodiments are also possible. In particular, the controller can be designed, especially in terms of programming, to control at least one function of the cleaning device, e.g., at least one program sequence of at least one cleaning program. The controller can furthermore comprise at least one user interface, e.g., at least one input device, which enables a user to communicate at least one command and/or at least one item of information to the controller. For example, the user interface can comprise at least one keyboard and/or at least one key and/or at least one switch. Furthermore, the user interface can comprise at least one output device, e.g., at least one display and/or at least one indication device. Furthermore, the controller can comprise at least one electronic interface, e.g., at least one wireless or, alternatively, wired interface. For example, the controller can be or comprise a central machine controller, by means of which one or more cleaning programs, in particular one or more washing programs, can be controlled. For example, the controller can be designed to control at least one washing operation, at least one rinsing operation and, optionally, at least one drying operation.

In particular, the controller can be designed to control the electromechanical drive. Thus, for example, the controller can be designed to start or stop the electromechanical drive, to determine or reverse a movement direction of the electromechanical drive, to determine a speed of the electromechanical drive or even to perform a combination of said control operations, e.g., by transmitting a corresponding electric signal. For example, the controller can be connected to the electromechanical drive, e.g., by wire or wirelessly, via at least one interface.

The cleaning device, in particular the controller, can, in particular, be designed in at least one of the following ways:

- the cleaning device, in particular the controller, is designed to detect the action of a manual force in the opening movement direction and to control the electromechanical drive in such a way that the covering device is moved in the opening movement direction; and/or the cleaning device, in particular the controller, is designed to detect the action of a manual force in the closing movement direction and to control the electromechanical drive in such a way that the covering device is moved in the closing movement direction.

As explained above, it is possible in this way to assist or independently continue a detected user-induced opening or closing movement by means of the electromechanical drive, e.g., as far as the open position or as far as the closed position.

As explained above, the electromechanical drive can, in particular, comprise at least one motor, in particular an electric motor, in particular a geared motor. In particular, the motor can be a DC geared motor. However, other embodiments are also possible in principle.

In particular, the motor can be a non-self-locking motor, e.g., a non-self-locking electric motor, preferably a non-self-locking DC motor. Here, a "non-self-locking" motor should be taken to mean, in general, a motor which allows movement of its drive spindle or drive shaft when it is not being controlled and, for example, is not being energized. In this way, an initial manual movement of the covering device can be initiated, for example, without the motor significantly inhibiting this movement. In particular, the cleaning device can be designed in such a way that the motor is moved simultaneously by the action of a manual force on the covering device, wherein the sensor is designed to detect a movement of the motor, in particular a rotary movement. For example, as explained above, the sensor can comprise at least one incremental encoder, which detects a rotary movement of the motor induced by the manual movement of the covering device. In the sense according to this disclosure, an "incremental encoder" should, in particular, be understood to mean a sensor which is designed to detect position changes, in particular position changes during a linear movement of the covering device and/or of the electromechanical drive, and/or angle changes, e.g., angle changes during a rotary movement of the covering device and/or of the electromechanical drive, in particular motor. However, other embodiments are also possible in principle.

As explained above, it is also possible, in particular, for the sensor to be designed to detect a direction of the action of a manual force. In particular, this direction detection can be used to assist the detected user-induced movement in the direction desired by the user, or even to continue it independently, by means of the electromechanical drive.

In general, the at least one sensor can be arranged at different points in the cleaning device in order to perform the function mentioned. A combination of sensors is also possible in principle. In particular, the sensor can be connected to at least one element selected from the group comprising: the covering device, the transmission, the electromechanical drive. Thus, in particular, the sensor can have at least one incremental encoder connected to the electromechanical drive.

In particular, the sensor can be designed to detect the action of a manual force on the covering device from a movement. Thus, as explained above, the action of a manual force on the covering device can, in particular, initiate a movement of the covering device, preferably a minimal movement, e.g., a linear movement of 50 mm or less, in particular 30 mm or less, e.g., 10 mm or less, in particular 5 mm or less. Owing to this preferred smallness of the movement, an expenditure of force required of a user to initiate the movement can be kept as small as possible. In particular, the movement can be selected from a movement of the covering device, a movement of the transmission and a movement of the electromechanical drive. Combinations are also possible.

To detect the movement, it is possible, in particular, to use a threshold value method. Thus, for example, it is possible to detect whether, on the basis of the action of a manual force, the covering device moves by more than a predetermined threshold value or by at least a predetermined threshold value, e.g., upward or downward, e.g., in the opening direction or in the closing direction. In particular, detection of the movement can, in general, be connected with an enquiry as to whether or not the electromechanical drive is currently being controlled in order to move the covering device. Thus, for example, the cleaning device can be designed in such a way that, when a movement by at least a predetermined threshold value or by more than a predetermined threshold value is detected, this is only recognized as a movement owing to the action of a manual force if the covering device is not simultaneously being driven by the electromechanical drive. Only then is it possible, for example, for the controller to interpret this movement as a desire of the user to carry out an opening or closing movement.

In general, therefore, the cleaning device can, in particular, be designed to compare the movement with at least one threshold value, e.g., by comparing a movement distance traveled or a traveled angle of the covering device, of the transmission or of the electromechanical drive with the at least one threshold value in order to detect the action of a manual force on the covering device. As explained above, it is additionally possible, as a further boundary condition, to detect whether the electromechanical drive is in operation or not, thus making it possible, for example, to exclude movements induced by the electromechanical drive.

In particular, the transmission can comprise at least one traction-means transmission, in particular at least one chain drive. Here, a traction-means transmission should be taken to mean, in general, a transmission in which a torque is transmitted between two elements, e.g., between at least one shaft and at least one further element, in particular also between two shafts, with the aid of a traction means, e.g., a traction means wrapped around the at least one shaft. In general, a traction means can be taken to mean a deformable, e.g., flexible or stretchable elongate element, by means of which a traction force can be transmitted. For example, the power transmission section can have at least one traction means, in particular a flexible traction means. In particular, the traction means can be selected from the group comprising: a chain, in particular a roller chain, a plate link chain or a link chain; a cable and/or control cable; a flexible band; a belt, in particular a toothed belt or a V-belt. However, other traction means can also be used in principle.

In principle, the abovementioned at least one sensor of the cleaning device can be arranged at at least one arbitrary point within the cleaning device suitable for detecting the action of a manual force on the covering device in the opening movement direction or in the closing movement direction. If the cleaning device comprises a transmission and/or a power transmission section, for example, the at least one sensor can be arranged at any desired point within this transmission and/or within this power transmission section, for example. Thus, for example, the sensor can be arranged relatively far forward in the overall power transmission path, e.g., in the form of a strain gauge, which can be arranged on a linkage or on a first chain, for example. As a result, relatively short travels are required at the covering device, e.g., at the hood, to detect the action of a force. This embodiment can also be used, for example, in combination with a drive motor which is self-locking. However, other embodiments are also possible in principle.

The cleaning device can furthermore have additional functions. Thus, the cleaning device can furthermore be designed, for example, to start at least one cleaning program, in particular at least one washing program, after a closing movement has been carried out, once the covering device has reached the closed position. In the case of a hood-type dishwasher, for example, the hood can be in the closed position, in particular the lower end position, after closing, and a washing program can then automatically be started in addition, particularly if the controller is appropriately parameterized.

As explained above, a method for cleaning items to be cleaned is proposed in a second aspect of this disclosure. In particular, the method can be carried out using the cleaning device according to this disclosure, in particular according to one or more of the above-described embodiments and/or according to one or more of the embodiments described below. Accordingly, reference can be made to the description of the cleaning device for possible definitions and/or options of the method.

The method comprises various method steps, which can be carried out in the sequence mentioned, for example. However, a different sequence is also possible in principle. The method can furthermore comprise additional method steps that are not mentioned. Moreover, it is also possible for one or more or even all of the method steps to be repeated and/or carried out continuously. Furthermore, two or more of the method steps mentioned or even all of the method steps mentioned can also be carried out simultaneously or with a time overlap.

In the method, at least one covering device at least partially surrounding the cleaning chamber is used. The covering device can be moved in an opening movement direction from a closed position into an open position or in a closing movement direction from an open position into a closed position by means of at least one electromechanical drive via at least one transmission.

The method comprises detecting the action of a manual force on the covering device in the opening movement direction or in the closing movement direction by means of at least one sensor. The method furthermore comprises controlling the electromechanical drive in accordance with the detection of the action of a manual force.

The method can furthermore comprise applying at least one cleaning fluid to the items to be cleaned in the cleaning device, e.g., by means of at least one application device. This application can take place, for example, after the covering device has been moved into the closed position in the closing movement direction.

As explained above, control of the electromechanical drive can, in particular, comprise at least one of the following steps: when the action of a manual force in the opening movement direction is detected, the electromechanical drive is controlled in such a way that the covering device is moved in the opening movement direction; when the action of a manual force in the closing movement direction is detected, the electromechanical drive is controlled in such a way that the covering device is moved in the closing movement direction.

The cleaning device and the method have numerous advantages over known devices and methods of the type mentioned. Thus, it is possible to implement assistance for an opening or closing movement of a covering device in a simple manner without this leading to a need for considerable additional expenditure on apparatus. In particular, additional switches, buttons, proximity sensors or similar expensive sensors which indicate a user's intention as regards opening or closing the covering device are eliminated. This also eliminates the problems with the cabling of such switches or buttons or sensors and the problems with the arrangement of these devices.

In contrast, the sensor is easy to implement. The sensor can also be used for multiple functions. Thus, for example, incremental encoders are easy to implement in transmissions or in motors. Such incremental encoders can also be used, for example, to monitor a functionality of the motor.

Operation can be made very intuitive since the user in any case generally acts on the covering device for opening or closure. This action can be detected and automatically assisted. Users may not even be aware that their application of force to the covering device is triggering a switching operation, by means of which the movement of the covering device is assisted or automatically taken over by the electromechanical drive.

For example, the covering device can have at least one handle or at least one lever which can be used by the user for the opening or closing operation. An additional button or an additional switch is no longer required since the covering device itself and the movement thereof can be used as a control element, for example.

The opening or closure of the covering device does not necessarily have to be triggered by the action of a manual force on the covering device. In addition to this option of triggering the opening or closing movement by the action of a manual force, other triggers for an opening or closing movement can also be provided. Thus, for example, the cleaning device can be designed in such a way that, in addition to the embodiment according to this disclosure, a program-controlled opening or closing movement also takes place, during which the opening or closing movement is not necessarily triggered by an impulse given by the user. For example, the cleaning device, in particular the controller, can be designed in such a way that the covering device, e.g., the hood, is opened automatically at the end of a cleaning program, e.g., in accordance with a parameterization of the cleaning program.

This disclosure can be implemented in a particularly advantageous manner on hood-type dishwashers or pass-through dishwashers, in which a heavy load or one or two vertical panels have to be moved. For example, the hood can be driven by means of a motor, e.g., a DC geared motor, via chains or other traction means. At the shaft end of the motor, there can be an incremental encoder by means of which monitoring functions are implemented. The geared motor can be designed in such a way that it is not self-locking. As a result, it is also possible for the hood to be actuated by hand, e.g., in the case of a fault. By means of this design, it is possible to move the hood by hand, as a result of which the motor is moved simultaneously. Incremental encoders can detect a rotary movement of the motor and the associated working direction and can transmit this information to the controller, e.g., by means of at least one signal. The controller can evaluate this signal, can interpret the desire for movement and can then drive the motor in the corresponding direction. As explained above, a movement can be detected by means of a threshold value method, for example. For example, a hood travel of 5 mm or more can be detected, and the motor can then be driven in the corresponding direction. In principle, there is no need for separate buttons or switches, even if these may be present anyway, and therefore increased fitting and installation requirements are avoided and thus a cost reduction can be made possible. Normally, hood-type dishwashers are in any case designed with one or more handles on the hood or with one or more levers on the hood, which are, in principle, generally in an advantageous position relative to the working position of the operator and which can be suitable for operation even without direct visual contact, for example. Overall, this disclosure results in a situation which is user-friendly and safe in operation.

In summary, the following embodiments are particularly preferred in the context of this disclosure:

Embodiment 1: cleaning device for cleaning items to be cleaned, comprising at least one cleaning chamber and at least one covering device at least partially surrounding the cleaning chamber, wherein the covering device can be moved in an opening movement direction from a closed position into an open position or in a closing movement direction from an open position into a closed position by means of at least one electromechanical drive via at least one transmission, wherein the cleaning device furthermore has a sensor, wherein the sensor is designed to detect the action of a manual force on the covering device in the opening movement direction or in the closing movement direction, and wherein the cleaning device is furthermore designed to control the electromechanical drive in accordance with the detection of the action of a manual force.

Embodiment 2: cleaning device according to the preceding embodiment, wherein the cleaning device is a dishwasher.

Embodiment 3: cleaning device according to the preceding embodiment, wherein the dishwasher is selected from a hood-type dishwasher and a pass-through dishwasher.

Embodiment 4: cleaning device according to one of the preceding embodiments, wherein the opening movement direction and the closing movement direction each have at least one vertical direction component.

Embodiment 5: cleaning device according to one of the preceding embodiments, wherein the covering device has different potential energy, in particular different position energy, in the closed position and in the open position.

Embodiment 6: cleaning device according to one of the preceding embodiments, wherein the covering device is arranged at least partially above the closed position in the open position.

Embodiment 7: cleaning device according to one of the preceding embodiments, further comprising at least one application device for applying at least one cleaning fluid to the items to be cleaned in the cleaning chamber.

Embodiment 8: cleaning device according to the preceding embodiment, wherein the cleaning device has at least one preparation tank formed separately from the cleaning chamber, in particular a boiler, wherein the temperature of a rinsing liquid can be set in the preparation tank while a washing operation is taking place in the cleaning chamber.

Embodiment 9: cleaning device according to one of the preceding embodiments, wherein the covering device is a linear-motion covering device.

Embodiment 10: cleaning device according to the preceding embodiment, wherein the cleaning device has at least one linear guide for the covering device, in particular a guide rail and/or a guide rod.

Embodiment 11: cleaning device according to one of the preceding embodiments, wherein the covering device is selected from the group comprising: a hood at least partially covering and/or surrounding the cleaning chamber; a jacket at least partially surrounding the cleaning chamber; a door, in particular one or more sliding doors.

Embodiment 12: cleaning device according to one of the preceding embodiments, wherein the cleaning device has a controller, wherein the controller is designed to control the electromechanical drive.

Embodiment 13: cleaning device according to one of the preceding embodiments, wherein the cleaning device, in particular the controller, is designed in at least one of the following ways: the cleaning device, in particular the controller, is designed to detect the action of a manual force in the opening movement direction and to control the electromechanical drive in such a way that the covering device is moved in the opening movement direction; the cleaning device, in particular the controller, is designed to detect the action of a manual force in the closing movement direction and to control the electromechanical drive in such a way that the covering device is moved in the closing movement direction.

Embodiment 14: cleaning device according to one of the preceding embodiments, wherein the electromechanical drive comprises a motor, in particular an electric motor, in particular a geared motor.

Embodiment 15: cleaning device according to the preceding embodiment, wherein the motor is a DC geared motor.

Embodiment 16: cleaning device according to one of the preceding embodiments, wherein the motor is a non-self-locking motor.

Embodiment 17: cleaning device according to one of the preceding embodiments, wherein the cleaning device is designed in such a way that the motor is moved simultaneously by the action of a manual force on the covering device, wherein the sensor is designed to detect a movement of the motor, in particular a rotary movement.

Embodiment 18: cleaning device according to one of the preceding embodiments, wherein the sensor is designed to detect a direction of the action of a manual force.

Embodiment 19: cleaning device according to one of the preceding embodiments, wherein the sensor is connected to at least one element selected from the group comprising: the covering device, the transmission, the electromechanical drive.

Embodiment 20: cleaning device according to one of the preceding embodiments, wherein the sensor has at least one incremental encoder connected to the electromechanical drive.

Embodiment 21: cleaning device according to one of the preceding embodiments, wherein the sensor is designed to detect the action of a manual force on the covering device from a movement.

Embodiment 22: cleaning device according to the preceding embodiment, wherein the movement is selected from a movement of the covering device, a movement of the transmission and a movement of the electromechanical drive.

Embodiment 23: cleaning device according to one of the two preceding embodiments, wherein the cleaning device is designed to compare the movement with at least one threshold value in order to detect the action of a manual force on the covering device.

Embodiment 24: cleaning device according to one of the preceding embodiments, wherein the transmission comprises at least one traction-means transmission.

Embodiment 25: cleaning device according to the preceding embodiment, wherein the traction-means transmission comprises at least one traction means selected from the group comprising: a chain, in particular a roller chain, a plate link chain or a link chain; a cable or control cable; a flexible band; a belt, in particular a toothed belt or a V-belt.

Embodiment 26: cleaning device according to one of the preceding embodiments, wherein the cleaning device is furthermore designed to start at least one cleaning program after a closing movement has been carried out, once the covering device has reached the closed position.

Embodiment 27: method for cleaning items to be cleaned comprising cleaning the items to be cleaned in at least one cleaning chamber, wherein at least one covering device at least partially surrounding the cleaning chamber is used, wherein the covering device can be moved in an opening movement direction from a closed position into an open position or in a closing movement direction from an open position into a closed position by means of at least one electromechanical drive via at least one transmission, wherein the method furthermore comprises detecting the action of a manual force on the covering device in the opening movement direction or in the closing movement direction by means of at least one sensor, and wherein the method furthermore comprises controlling the electromechanical drive in accordance with the detection of the action of a manual force.

Embodiment 28: method according to the preceding embodiment, wherein the control of the electromechanical drive comprises at least one of the following steps: when the action of a manual force in the opening movement direction is detected, the electromechanical drive is controlled in such a way that the covering device is moved in the opening movement direction; when the action of a manual force in the closing movement direction is detected, the electromechanical drive is controlled in such a way that the covering device is moved in the closing movement direction.

Embodiment 29: method according to one of the two preceding embodiments, wherein a cleaning device according to one of the preceding embodiments relating to a cleaning device is used.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
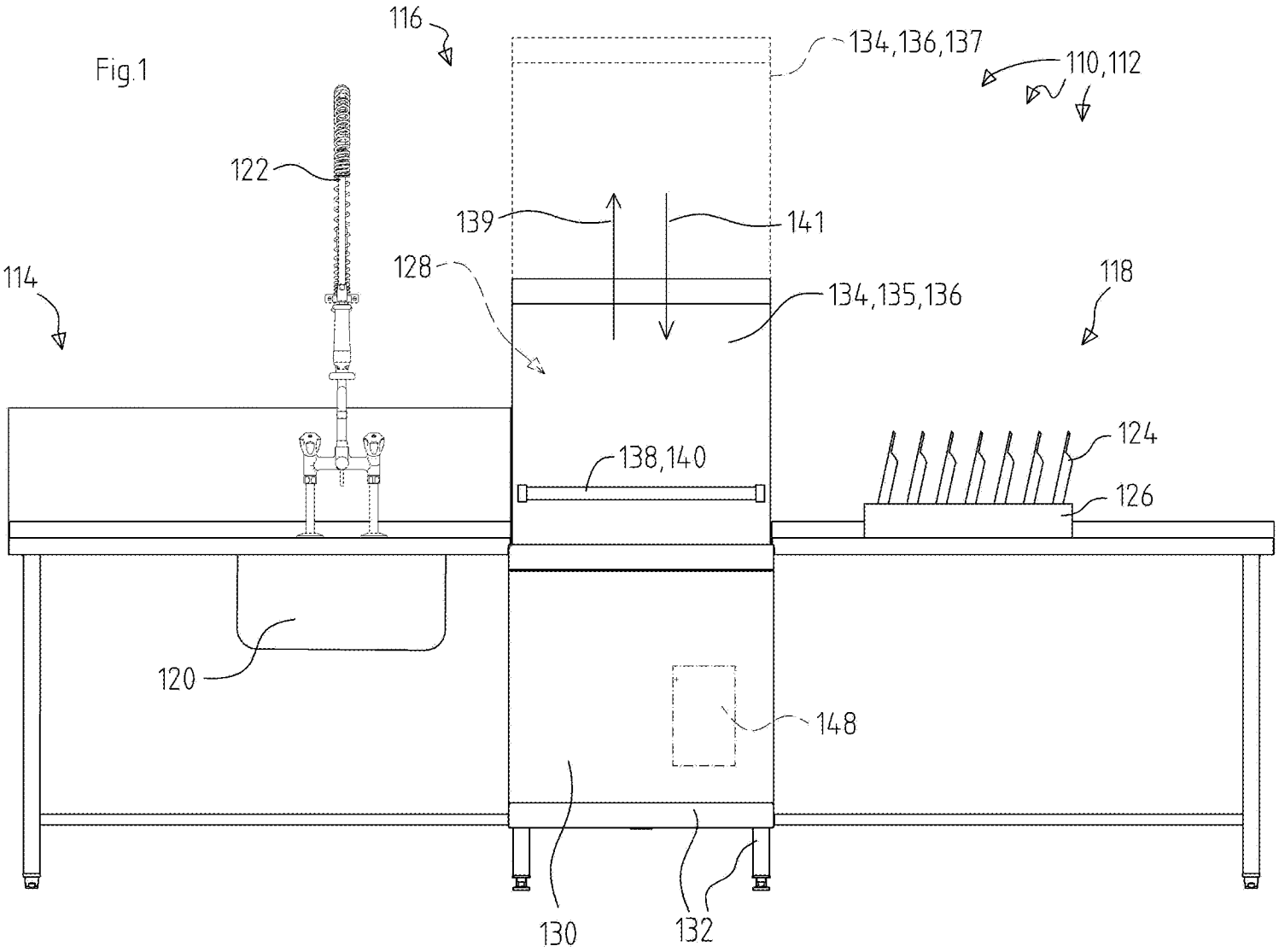
FIG. 1 shows an illustrative front view of a pass-through dishwasher in the form of a hood-type dishwasher, in which this disclosure can be implemented.
Figure 2:
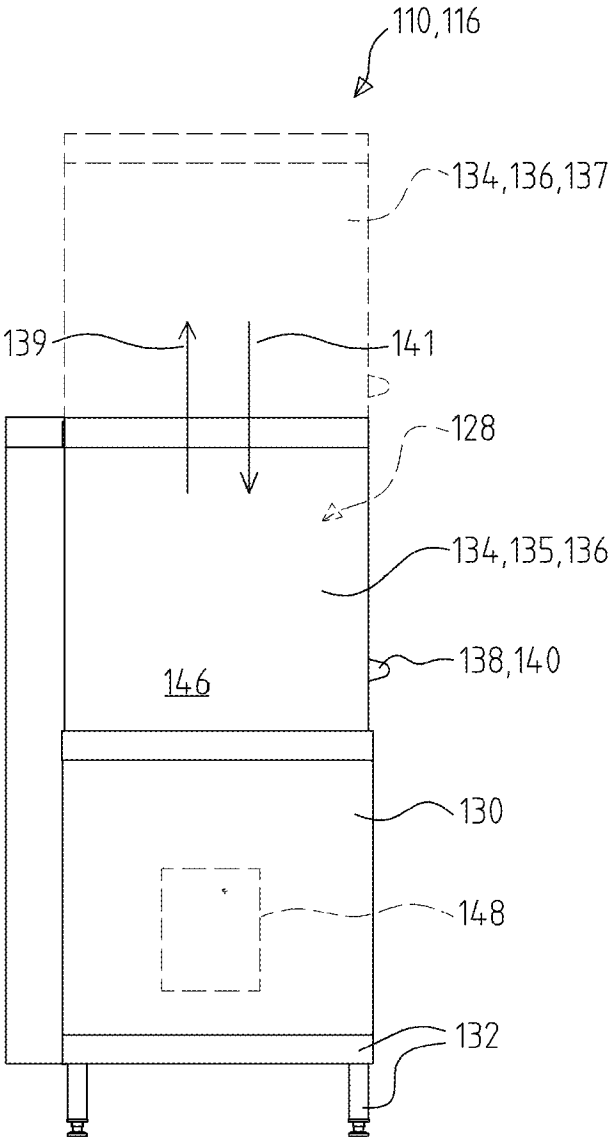
FIG. 2 shows a side view of the hood-type dishwasher shown in FIG. 1.

FIG. 1 shows an illustrative embodiment of a cleaning device 110 according to this disclosure. In this illustrative embodiment, the cleaning device 110 is designed as a pass-through dishwasher 112, which comprises an inlet table or feed table 114, a hood-type dishwasher 116 and an outlet table 118. In FIG. 1, the cleaning device 110 is shown in front view. In FIG. 2, the hood-type dishwasher 116 is shown again in a side view.

In addition to the hood-type dishwasher 116, the cleaning device 110 can comprise, by way of example, a sink 120 and a hose-type spray 122 for pre-cleaning the items to be cleaned 124 in the region of the feed table 114, it being possible for said items to be, for example, crockery or other types of abovementioned items to be cleaned. The items to be cleaned 124 can be introduced into a cleaning chamber 128 of the cleaning device 110 by means of one or more crockery baskets 126, for example. There, one or more cleaning fluids can be applied to the items to be cleaned 124, e.g., by means of one or more application devices, e.g., nozzle systems, which are not illustrated specifically in FIGS. 1 and 2.

The hood-type dishwasher 116 has a base 130, which has a stand 132, for example. The hood-type dishwasher 116 furthermore comprises a covering device (or "cover") 134, which, by way of example, is designed as a hood 136 in this illustrative embodiment. This hood 136 can be opened over an opening path and, in FIGS. 1 and 2, is in each case illustrated in solid lines in a closed position 135 and in dashed lines in an open position 137. The direction of a movement from the closed position 135 into the open position 137 defines an opening movement direction 139, and the opposite direction of a movement from the open position 137 into the closed position 135 defines a closing movement direction 141.

The hood-type dishwasher 116 furthermore has at least one actuating element (actuator) 138 in the form of a handle 140. In FIG. 2, similarly to the illustration of the hood 136, the handle 140 is illustrated in solid lines in the closed position 135 and in dashed lines in the open position 137. The handle 140 acts directly on the hood 136, for example.

At least one controller 148 can furthermore be arranged in the base 130 of the hood-type dishwasher 116. However, it is also possible, for example, as an alternative or in addition, for a controller 148 to be arranged at different locations in the hood-type dishwasher 116. Further elements, e.g., at least one preparation tank, in which the temperature of a rinsing liquid can be set, e.g., at least one boiler, can furthermore be arranged in the base 130. These elements are not shown in the figures.

The hood 136 is connected to at least one electromechanical drive 188 by at least one transmission 184. The electromechanical drive 188 is designed to move the hood 136 in the opening movement direction 139 or the closing movement direction 141 via the transmission 184, in order, for example, to move the hood 136 from the closed position 135 into the open position 137 or vice versa. As described below, the transmission 184 can be or have a traction-means transmission 185, for example, as explained in greater detail below. The transmission 184 comprises, for example, a power transmission section 182, one or more torque transmission elements 168, one or more torque converters 166, one or more chain sprockets 162, 170, one or more traction means (or "traction members") 158, 172 and, if appropriate, further elements. However, it should be noted that other types of transmissions 184 can also be used in the context of this disclosure, e.g., transmissions 184 without a traction means and/or transmissions 184 without a torque converter. The following description of the transmission 184 should thus be regarded as illustrative.

Figure 3:
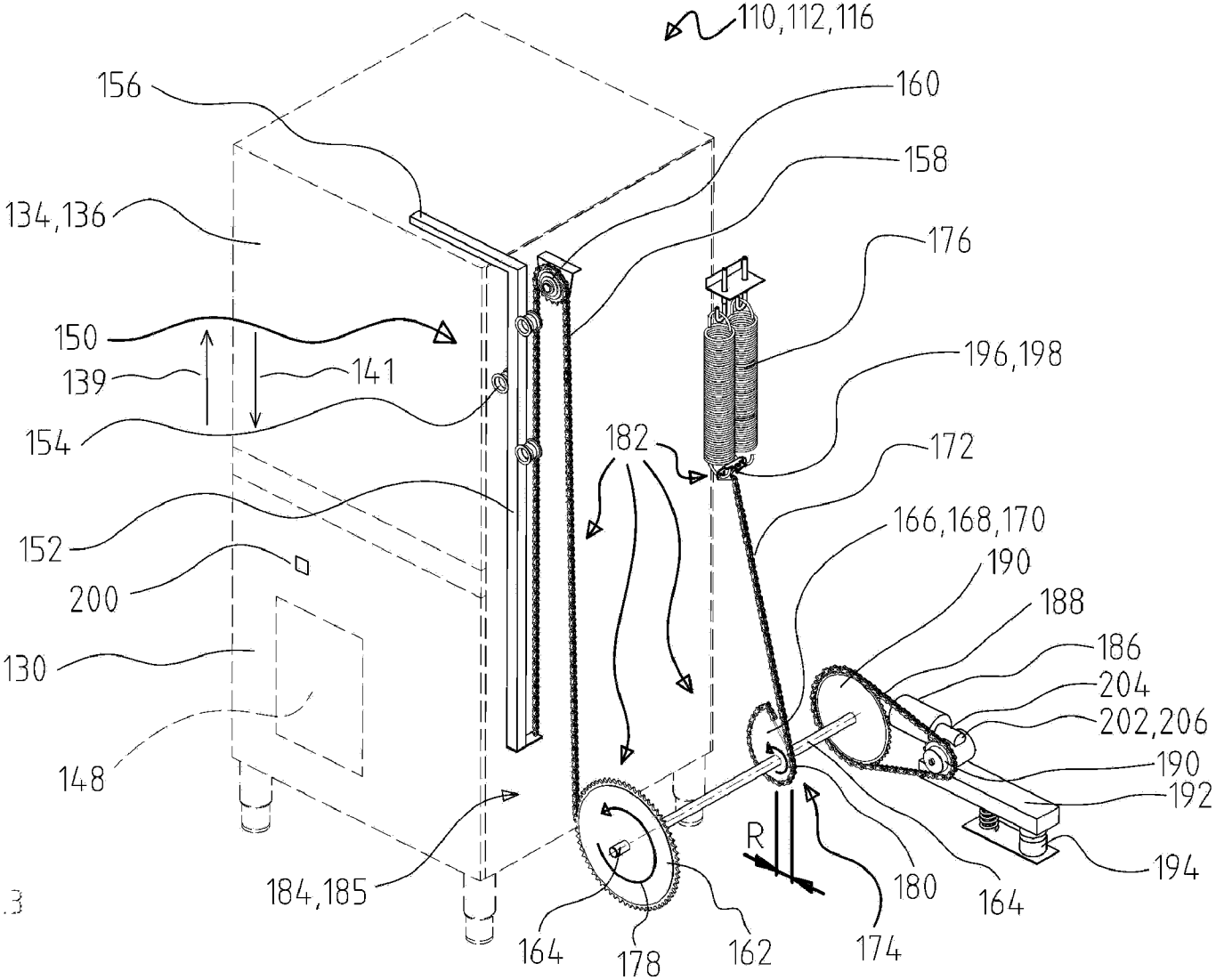
FIG. 3 shows a schematic view of a power transmission section and of spring elements for compensating the weight of the hood-type dishwasher.

The cleaning device 110 has guide elements 150 on both sides on the rear side thereof, wherein one of these guide elements 150 is illustrated schematically in FIG. 3. As illustrated in FIG. 3, this guide element 150 can have a guide rail 152 or some other type of guide profile, for example, e.g., a rectangular profile in the form of a rectangular-section tube and/or square-section tube. As shown in FIG. 3, this is arranged vertically. Each guide element 150 is supported by means of rollers 154, for example, e.g., three rollers on each side. A forward-pointing cantilever arm 156 is formed at the top of each of the guide elements 150, onto which arms the hood 136, which is fully preassembled for example, can be pushed and secured, for example, by just a small number of fastening elements, e.g., two screws.

A first traction means 158, e.g., at least one first roller chain, is fastened to each guide element 150 at the bottom. This first traction means 158 is in each case guided over a deflection sprocket 160 in the upper region of a housing of the cleaning device 110. The first traction means 158 is furthermore placed in each case on a first chain sprocket 162 in the lower region of the housing. The illustrated arrangement of the guide element 150, of the first traction means 158, of the deflection sprocket 160 and of the first chain sprocket 162 is arranged in duplicated form on the opposite side of the rear side of the cleaning device 110, and therefore there are two first chain sprockets 162, these being of the same type for example, of which only one is illustrated in FIG. 3 to simplify the illustration. The two first chain sprockets 162 are connected rigidly in terms of rotation by a shaft 164, on which they are mounted for conjoint rotation. Moreover, a torque converter 166 is mounted on this shaft 164, likewise in a rigid manner in terms of rotation. This converter comprises a rotatably mounted torque transmission element 168, which is designed as a third chain sprocket 170 in this illustrative embodiment. This third chain sprocket 170 is mounted so as to be rotatable about the axis of the shaft 164. A third traction means 172 is furthermore placed on this third chain sprocket 170, said traction means rising from the third chain sprocket 170 at a point of engagement 174 and being connected at its other end, in this illustrative embodiment by way of example, to two spring elements 176. In FIG. 3, the hood 136 is illustrated in the closed position 135. During a movement along an opening path, the guide element 150 moves upward, and the first chain sprockets 162 rotate in a direction of rotation 178. During this opening movement, the third chain sprocket 170 rotates in a direction of rotation 180, which is, for example, the same as direction of rotation 178.

Here, the torque transmission element 168 in the form of the third chain sprocket 170 is formed with a nonuniform radius, for example, as can be seen in FIG. 3. This means that a distance R between the point of engagement 174 and the axis changes with an angular position of the torque transmission element 168. However, this also involves a change in the torque transmitted by the third traction means 172 to the shaft 164 since this torque is dependent on the angular position of the chain sprocket 170.

When the hood 136 is closed, the two chains of the first traction means 158, which are fastened to the guide rails 152 at the bottom, are to a large extent unwound from the chain sprockets 162. In contrast, the third traction means 172, likewise in the form of a roller chain, for example, is to a large extent wound onto its third chain sprocket 170, and the spring elements or springs 176, which are designed as tension springs for example, are tensioned, as shown in FIG. 3. As the hood 136 is raised, the two first traction means 158 are wound onto their sprockets 162. At the same time, the third traction means 172 is unwound and the spring elements 176 relax.

In order to compensate for the change in the spring force of the spring elements 176 over the opening path, the third chain sprocket 170 has a radius of action and/or pitch circle which changes over the circumference, as explained above. By virtue of this embodiment, the change in the spring force over the opening path or over the extension can adapt to the actually required force to compensate the weight of the hood 136. In addition to a uniform and/or continuous reduction in the radius or increase in the radius, it is also possible to implement nonuniform adaptations of the radius of action R. Thus, for example, abrupt changes in diameter can also be incorporated into the chain sprockets in order to damp a movement at the end positions, for example.

The traction means 158 and the torque converter 166 are part of a power transmission section 182, by means of which a spring force of the at least one spring element 176 can be transmitted in modified form to the covering device 134. In this illustrative embodiment, the power transmission section 182 is part of the transmission 184. Further component parts of the power transmission section can be the deflection sprockets 160 as well as the first chain sprockets 162 and the shaft 164. Owing to the variation in the radius of action R with respect to the angular position, the torque converter 166 and hence the entire power transmission section 182 has a variable transmission ratio over the opening path. Thus, the torque converter 166 is, for example, a component part of the transmission 184 which, in this illustrative embodiment, has a variable transmission ratio that varies over the opening path of the hood 136. However, it should be noted that embodiments of this disclosure in which a transmission with a fixed transmission ratio is used, rather than a transmission 184 with a variable transmission ratio, are also possible.

The chain sprockets 162, 170 can be manufactured and assembled individually from metal, for example. Furthermore, individual parts of the sprocket set, e.g., guide disks, can also be manufactured completely or partially from plastic. Manufacture of the entire sprocket set from plastic is also conceivable. The sprocket set is preferably supported by rolling bearings, allowing lower friction and, as a result, free running. The chain sprockets 162 and the shaft 164 as well as the traction means 158, 172 can be further component parts of the transmission 184.

As already explained above, at least one electromechanical drive 186, e.g., at least one motor and particularly preferably at least one electric motor, is coupled to the transmission 184 to implement a semiautomatic and/or fully automatic hood 136. In particular, this can be a DC geared motor. The electromechanical drive 186 can be coupled by means of a further chain 188 and/or some other kind of traction means, for example, by means of two pinions 190, which can be of the same type or, alternatively, of different types, and/or by means of a further transmission with a fixed or variable transmission ratio.

In order to protect operators from excessive closing forces of the semiautomatic or fully automatic hood, several solutions can be adopted with an optional semiautomatic or even fully automatic hood. Thus, for example, the electric motor can be fastened in such a way that the torque thereof is absorbed via a spring-supported torque support 192. In the event of an excessive torque, e.g., an excessive closing force on the hood 136, this torque support 192 is deflected. This movement can be detected, for example, by means of a switch 194, which can transmit its signal to the controller 148. The controller 148 can then end the movement of the hood 136, for example, and optionally initiate a reverse movement.

As an alternative or in addition, at least one rotary encoder, which can likewise be connected to the controller 148, can be integrated into the power transmission section 182, including the electromechanical drive 186. This rotary encoder is not illustrated in FIG. 3. For example, the controller 148 can detect when the signals of the rotary encoder are absent, e.g., because a movement is hindered. In this case, the controller 148 can then end the movement of the hood, for example, and/or initiate a reverse movement. To limit any crushing force which may occur, the weight-compensating force for the hood 136 can be matched to the closing force exerted by the drive in such a way that harmless values are not exceeded.

In order to increase the safety of the operators in the case of failure of individual component parts of the weight compensation system, several elements of the power transmission section 182 can be of redundant design, for example. Thus, for example, two chains can be used in parallel or "back-to-back" instead of a single third traction means 172, e.g., a single third chain. It is furthermore possible, as an alternative or in addition, to supplement the third traction means 172 by a further deformable component part and/or traction means, e.g., a cable, which can take up the tensile force if the chain breaks.

Further possible embodiments relate to safeguarding elements, which offer a safeguard if the at least one spring element 176 breaks. Thus, for example, the spring element 176 can have at least one safeguarding element 196, which can be a component part of the spring elements 176 themselves, for example, or, alternatively, can be coupled to said spring elements, the intention being to include this possibility as well. For example, this safeguarding element 196 can comprise a catch element or a catch device, which, by way of example, is coupled to the two spring elements 176 in this illustrative embodiment. For example, this safeguarding element can have at least one safeguarding rod 198, wherein the power transmission section 182 can couple to the safeguarding rod 198 if the at least one spring element 176 or, as the case may be, a plurality of spring elements 176 breaks. However, other embodiments are also possible.

As explained above, it is possible, in particular, for two first traction means 158 to be provided. However, a different number is also possible. Furthermore, two or more of said elements can also be fully or partially combined. Thus, for example, the two first traction means 158 can also be made shorter and, for example, connected to a single chain, which can then be connected individually, via the sprocket set, to the weight-compensating spring elements 176.

Instead of said roller chains, this disclosure can also be implemented with other flexible or deformable traction means or, alternatively, in combination with various types of traction means. For example, plate link chains, link chains, belts or cables can be used.

To actuate a hood movement, a user, in particular an operator, can, for example, actuate one or more control elements 200, which can be arranged laterally or on a front side of the base 130 and/or of the hood 136, for example. These can act on the controller 148, for example, which, in turn, controls the electromechanical drive 186. As explained above, however, the arrangement and the electrical connection of the at least one control element 200 are fundamentally problematic. Particularly in the case of the arrangement illustrated in FIG. 1, it may be that the operator has to leave the workplace at the sink 120 in order to initiate a movement of the hood 136.

As explained above, at least one sensor 202 is provided to solve these problems in the context of this disclosure, said sensor being designed to detect the action of a manual force on the covering device 134 and, in particular, the hood 136 and preferably also the direction of this action of a force. In this way, it is possible, for example, for the hood 136 to be raised slightly by a user, i.e., moved in the opening movement direction 139, when it is in the closed position 135, this movement being detected by the sensor 202. For example, movements of 5 mm or more or movements greater than 5 mm can be detected as a desire to move the hood 136 in this direction. Conversely, it is possible, for example, for the hood 136 to be pulled downward slightly by a user, in the closing movement direction 141, when it is in the open position 137, this movement being detected by the sensor 202. The detection of this action of a force and, if appropriate, of the direction of this action of a force can then be converted by the controller 148 into a corresponding control command for the electromechanical drive 186 in order then to assist the movement of the hood 136 in the desired direction by means of the electromechanical drive 186 or even to carry it out exclusively by means of the electromechanical drive 186. The hood 136 itself can thus be used as a kind of control element 200 inasmuch as a desire relating to a movement of the hood 136 is communicated to the controller 148 by the action of a force on this hood 136.

In principle, the sensor 202 can be arranged at different points within the cleaning device 110. Thus, for example, the at least one sensor 202 can be arranged at one or more of the following locations: on the hood 136; on the guide element 150; on the guide rail 152; within the transmission 184, for example within the power transmission section 182 and/or at some other point within the transmission 184; in the electromechanical drive 186. In the illustrative embodiment shown, the electromechanical drive 186 and/or the transmission 184 can, for example, comprise at least one driven shaft 204, which is preferably rotatable, preferably in both possible directions of rotation, by the electromechanical drive 186. The sensor 202 can, for example, comprise an incremental encoder 206, which can be arranged on one shaft end of the shaft 204, for example.

The sensor 202 can be connected to the controller 148 wirelessly or, alternatively, by wire, for example, in order to communicate therewith unidirectionally or, alternatively, bidirectionally. The controller 148 can, for example, be designed to evaluate the information from the sensor 202 and to send corresponding control commands to the electromechanical drive 186. The electromechanical drive 186 can be connected directly or indirectly, e.g., wirelessly or by wire, to the controller 148. Thus, for example, the controller 148 can be designed to start the electromechanical drive 186, to influence a direction of rotation thereof or, alternatively, to influence a speed of rotation thereof. Other embodiments are also possible. The controller 148 can, for example, be designed to evaluate signals and information from the sensor 202 by way of programming, e.g., through the use of a threshold value method. Thus, for example, a change in the position and/or of an increment transmitted by the sensor 202 can be monitored and, for example, compared with one or more threshold values. In this way, the above-described monitoring can be performed, for example, to determine whether the hood 136 has been moved by more than a predetermined distance through the action of a manual force, which can then be interpreted as a command for a further movement in the direction of this action of a force.

In particular, the electromechanical drive 186 can be designed as a DC geared motor. The DC geared motor can, for example, be designed in such a way that it is not self-locking. This means that a movement can be performed by hand and/or, even in the case of a fault, that the hood 136 can also be actuated by hand. The motor can be moved simultaneously in the process. The incremental encoder 206 can detect a rotary movement of the motor, for example, and transmit the associated working direction and these signals to the controller 148. The controller 148 can, for example, evaluate this signal, interpret the desire for movement and then drive the motor in the corresponding direction.

Moreover, the cleaning device 110 can also have additional functions. Thus, in particular, this can be designed to carry out at least one cleaning program, e.g., through corresponding programming of the controller 148. It is possible, for example, after a closing movement, when the hood 136 is in the closed position 135, to automatically start a washing program.

As explained above, there is, in particular, no need for separate buttons and/or switches in the embodiment according to this disclosure in order to initiate a movement of the hood 136. This eliminates the corresponding installation requirements and it is also possible to significantly reduce costs in comparison with conventional cleaning devices 110. The handle 140 is normally situated in an ergonomically favorable position on the hood 136, e.g., in an ergonomically favorable position relative to a workplace at the sink 120. Operators at this workplace can thus reach the handle 140 easily and hence initiate the hood movement, even without visual contact with the controller 148 and/or with corresponding control elements 200. Moreover, learning is generally not required since the hood movement is initiated intuitively with a corresponding movement of the handle 140. A user-friendly and operationally safe overall situation of the cleaning device 110 is thus obtained.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SIGNS

110 cleaning device
112 pass-through dishwasher
114 feed table
116 hood-type dishwasher
118 outlet table
120 sink
122 hose-type spray
124 items to be cleaned
126 crockery basket
128 cleaning chamber
130 base
132 stand
134 covering device
135 closed position
136 hood
137 open position
138 actuating element
139 opening movement direction
140 handle
141 closing movement direction
146 side wall
148 controller
150 guide element
152 guide rail
154 roller
156 cantilever arm
158 first traction means
160 deflection sprocket
162 first chain sprocket
164 shaft
166 torque converter
168 torque transmission element
170 third chain sprocket
172 third traction means
174 point of engagement
176 spring element
178 first direction of rotation
180 second direction of rotation
182 power transmission section
184 transmission
185 traction-means transmission
186 electromechanical drive
188 chain
190 pinion
192 torque support
194 switch
196 safeguarding element
198 safeguarding rod
200 control element
202 sensor
204 shaft
206 incremental encoder

What is claimed is:

1. A cleaning device, comprising:

a cleaning chamber;

a cover at least partially surrounding the cleaning chamber, wherein the cover is moveable in an opening direction from a closed position into an open position or in a closing direction from the open position into the closed position;

an electromechanical drive having a transmission configured to move the cover;

a sensor configured to detect action of a manual force on the cover in the opening direction and in the closing direction; and a controller configured to perform at least one of the following:

(i) upon detection of the action of the manual force in the opening direction, to control the electromechanical drive such that the cover is moved in the opening direction; and (ii) upon detection of the action of the manual force in the closing direction, to control the electromechanical drive such that the cover is moved in the closing direction.

2. The cleaning device as claimed in claim 1, wherein the cleaning device is a hood-type dishwasher or a pass-through dishwasher.

3. The cleaning device as claimed in claim 1, wherein the cover is a linear-motion cover.

4. The cleaning device as claimed in claim 1, wherein the cover is selected from the group consisting of: a hood at least partially covering the cleaning chamber; a hood at least partially surrounding the cleaning chamber; a jacket at least partially surrounding the cleaning chamber; and a door.

5. The cleaning device as claimed in claim 4, wherein the cover comprises the door and the door comprises one or more sliding doors.

6. The cleaning device as claimed in claim 1, wherein the cleaning device has a controller configured to control the electromechanical drive.

7. The cleaning device as claimed in claim 1, wherein the sensor has at least one incremental encoder connected to the electromechanical drive.

8. The cleaning device as claimed in claim 1, wherein the sensor is configured to detect the action of the manual force on the cover from a movement.

9. The cleaning device as claimed in claim 8, wherein the cleaning device is configured to compare the movement with at least one threshold value in order to detect the action of the manual force on the cover.

10. The cleaning device as claimed in claim 1, wherein the electromechanical drive comprises a non-self-locking motor.

11. The cleaning device as claimed in claim 10, wherein the motor is configured to move simultaneously with the action of the manual force on the cover, wherein the sensor is configured to detect a movement of the motor.

12. The cleaning device as claimed in claim 1, wherein the cleaning device is configured to start at least one cleaning program after a closing movement which positions the cover in the closed position.

* * * * *